US005713285A

United States Patent [19]

Reed et al.

[11] Patent Number: 5,713,285

[45] Date of Patent: Feb. 3, 1998

[54] POWDER SPRAY SYSTEMS AND METHODS FOR THEIR USE

[75] Inventors: Timothy R. Reed, Woodridge; William J. Meyer, Lombard, both of Ill.

[73] Assignee: Oxy-Dry Corporation, Itasca, Ill.

[21] Appl. No.: 541,315

[22] Filed: Oct. 6, 1995

[51] Int. Cl.[6] ..... B41F 35/00

[52] U.S. Cl. ..... 101/424.2; 101/416.1

[58] Field of Search ..... 101/424.2, 424.1, 101/419, 416.1, 483; 239/654, 683

[56] References Cited

U.S. PATENT DOCUMENTS

| | | | |
|---|---|---|---|
| 5,010,819 | 4/1991 | Uribe et al. | 101/425 |
| 5,083,710 | 1/1992 | McLoughlin et al. | 239/690 |
| 5,213,271 | 5/1993 | Uribe et al. | 239/654 |

*Primary Examiner*—Edgar S. Burr
*Assistant Examiner*—Anthony H. Nguyen
*Attorney, Agent, or Firm*—Leydig, Voit & Mayer, Ltd.

[57] ABSTRACT

An apparatus and method of use for spraying powder on substrate which is particularly suited for use in conjunction with a printing press for automatically applying a fine powder onto printed sheets prior to delivery to a stacking station. The electrically controlled and motor driven apparatus comprises a pressurized air source, a powder hopper with a powder agitator contained therein, a brush unit which transfers powder from the powder hopper and, through the use of a flicker bar, mixes powder with air to create an air and powder mixture in a powder chamber. Pressurized air passing through a venturi upwardly vacuums this mixture and propels the air and powder mixture through a selectable series of pneumatic hoses to nozzles with an adjustable width of spray for spraying powder on printed sheets.

27 Claims, 10 Drawing Sheets

POWDER SPRAY SYSTEMS AND METHODS FOR THEIR USE

FIELD OF THE INVENTION

The present invention relates generally to powder sprayers which have applications in various fields, but have particular utility when used in conjunction with printing presses for purposes of sheet separation and, more particularly, to automatic, pneumatic powder sprayers.

BACKGROUND OF THE INVENTION

In printing operations, powder distribution systems have been developed for directing a fine powder onto printed sheets prior to delivery to a stacking station in order to maintain sheet separation and to prevent the offset of the ink from one sheet to the next. Two types of powder distribution devices have generally been utilized. Roller type mechanical powder distribution devices are commonly employed, as are pneumatic powder sprayers, the latter employing nozzles to provide for such powder distribution.

Each type of the foregoing types of powder distribution devices generally consists of three basic components: a powder supply hopper which serves as a reservoir for powder; a powder discharge component which applies the powder onto the printed sheets; and a powder transport component which moves the powder from the hopper to the discharge component.

Roller type powder distribution devices typically comprise a box-like, powder-containing housing having an elongated discharge opening in the bottom thereof. A roller having a relieved outer surface is rotatably disposed within the housing. As the roller is rotated, doctor blades which define the discharge opening permit the distribution onto the printed sheets of only a metered quantity of powder. This quantity of powder is contained within the relieved areas of the roller, to be carried to a discharge zone outside the housing, thus distributing powder onto the printed sheets.

Roller type distribution devices have, however, presented numerous problems due to the mechanical nature of powder delivery they employ. These problems range from clogging in the powder transport component to uneven powder distribution by the roller. Uneven powder distribution adversely affects the separation of the printed sheets and can cause the offset transfer of inks between adjacent sheets. Furthermore, powder "fly away," wherein excess powder becomes airborne, is also a problem with such mechanical roller type devices.

As press run speeds continue to increase with modern press technology, it becomes more difficult for the powder from a roller type device to be delivered to the fast-moving printed sheet. This is partly due to the boundary layer of air which is created by the printed sheets as they move past the device at a high rate of speed. As press speed increases, so does the boundary layer of air. The result of this phenomenon is a greater degree of uneven powder distribution to the printed sheet and more powder fly away.

In an effort to improve the uniformity of the distribution of the powder on the printed sheet and to minimize powder fly away, powder distribution devices which spray the powder onto the sheets have been developed. The use of air pressure to deliver powder in such devices offers certain advantages over roller type devices. One of these is that the powder supply hopper is permitted to located apart from the press itself, at a more accessible and convenient location. This advantage flows at least in part from the fact that, in such pneumatic powder sprayers, the powder is transported from the supply hopper to the point of discharge through pneumatic hoses.

One such system which purportedly addresses the aforesaid problems with roller type devices utilizes a Venturi nozzle mounted underneath a gravity-fed powder supply. This nozzle is intended to assist the powder in flowing through the pneumatic powder transport hose to the spray nozzles.

This type of pneumatic system, however, is not without its own problems. More specifically, the pneumatic powder transport hoses and spray nozzles can become plugged with a build-up of powder, or powder can accumulate at or near the nozzle opening, resulting in sudden bursts of white clouds of powder from the nozzles. This sudden burst results in the excessive and nonuniform distribution of powder on the printing sheets. Moreover, such powder build-up requires constant monitoring and extensive maintenance to ensure that the powder sprayer remains operational during the entire period the press is operating.

In view of the foregoing, it is an object of the present invention to provide a powder spray distribution system for applying powder to a substrate which requires less monitoring and maintenance than existing systems.

Another object of the present invention is to provide a powder distribution device which provides uniform delivery of powder onto a substrate and minimizes powder fly away.

Another object of the present invention is to provide a powder distribution device which minimizes the problems associated with nozzle plugging and powder accumulation in the powder transport hoses and nozzles of existing spray type distribution devices.

A further object of the present invention is to provide a powder distribution device which, if used in a printing press application, is not adversely affected by the air boundary layer generated by modern, high-speed, printing presses.

Another object of the present invention is to provide a powder distribution system that can be easily adjusted to compensate for substrates of varying widths.

Yet another object of the present invention is to provide a powder distribution system which is more economical to operate than existing systems.

The foregoing and other objects and advantages of the present invention, as well as additional inventive features, will be apparent from the description of the invention provided herein.

SUMMARY OF THE INVENTION

The present invention provides novel powder spray systems, and related methods, which overcome difficulties associated with existing systems. While the systems of the present invention find particular application when used in conjunction with printing presses for sheet separation, it may also be used in other applications where the advantages provided by these systems are desirable.

One aspect of the present invention is a powder spray system for directing a powder onto a substrate which comprises a source of pressurized air, a powder supply hopper serving as a storage and disbursement container for said powder, a spraying means, a powder transfer means in fluid communication with said supply hopper which transfers powder from said supply hopper to a powder chamber and mixes said powder transferred from said supply hopper with air inside said powder chamber creating an air and powder mixture, and a powder propulsion means in fluid communication with said source of pressurized air which uses said pressurized air to transfer said air and powder mixture from said powder chamber to said spraying means, wherein said spraying means directs said air and powder mixture onto the substrate material.

Another aspect of the present invention is the use of the foregoing system in conjunction with a printing press.

The invention may best be understood with reference to the accompanying drawings wherein an illustrative embodiment is shown and in the detailed description of the preferred embodiments which follows thereafter.

DESCRIPTION OF THE PREFERRED EMBODIMENTS

The present invention comprises several aspects and features which will be described in the following passages in terms of preferred embodiments.

Figure 1:
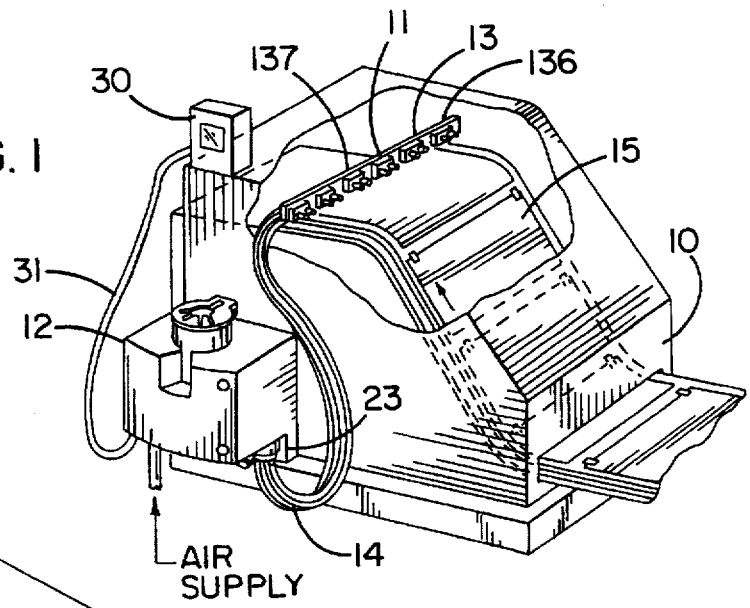
FIG. 1 is a perspective of the delivery end of a printing press having a powder sprayer system in accordance with an embodiment of the present invention a cover mounted thereon.

Referring initially to FIG. 1 of the drawings, which shows one preferred embodiment of the invention as used in the printing industry, there is shown the inclined delivery end of a printing press 10 having a powder spray system 11 mounted thereon, comprised of a powder supply system 12 connected to a sprayer bar 13 by a plurality of pneumatic hoses 14, with operating panel 30 and operating cable 31 in accordance with the present invention. The printing press 10 may be of any conventional type, in this case having a sheet delivery system wherein the powder spray system 11 directs powder onto successively transferred printed sheets 15 so as to maintain spacing between the sheets and to prevent the offset of ink from one printed sheet to another when the printed sheets 15 are stacked at a delivery station.

Figure 2:
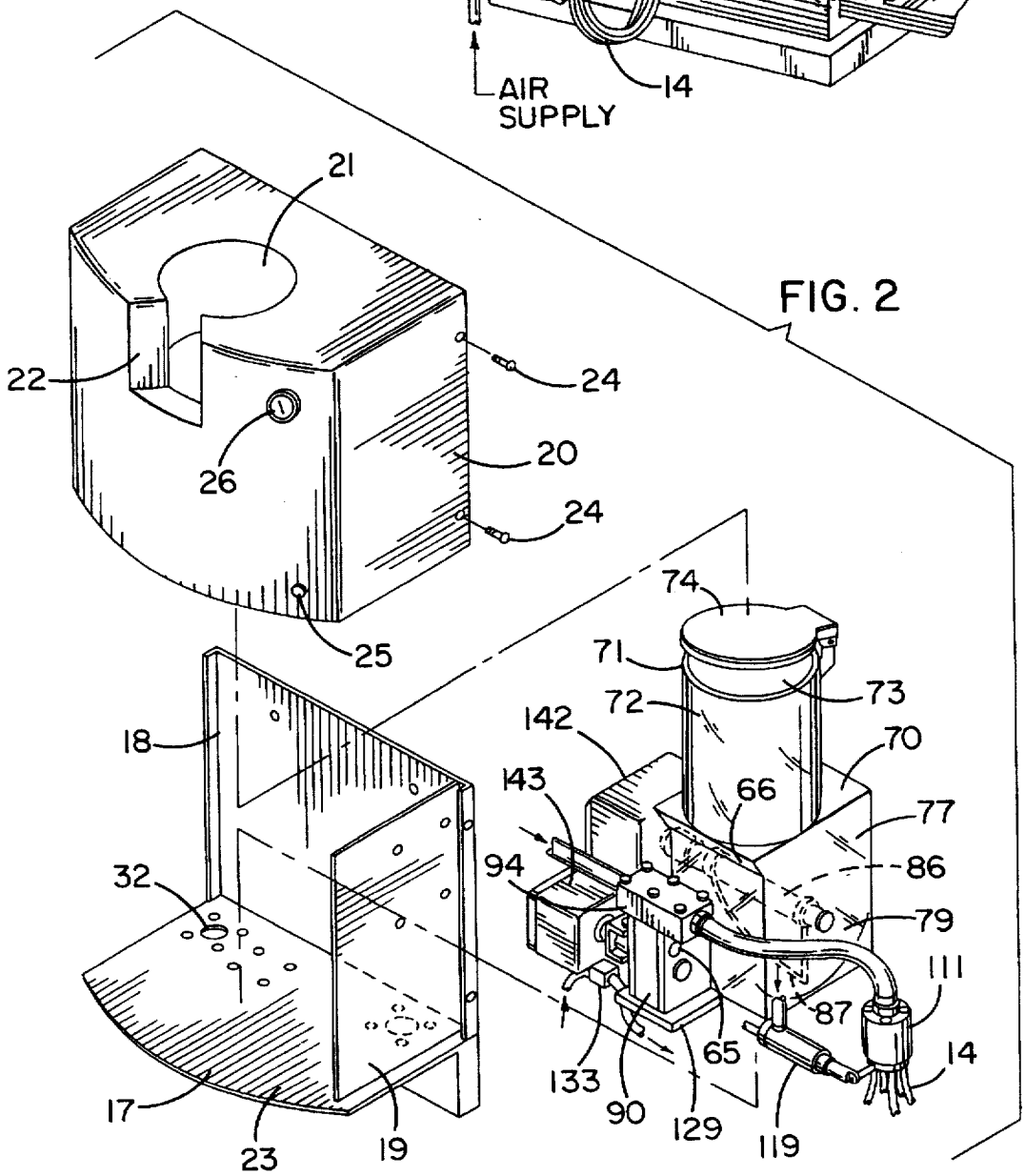
FIG. 2 is a partially exploded view of the powder supply system depicted in FIG. 1.

For providing a supply of powder to the powder spray system 11, a powder supply system 12, in the pictured embodiment of FIG. 1, with mounting bracket 23, is laterally mounted on the frame of the inclined delivery end of the printing press 10. As shown in FIG. 2, mounting bracket 23 has a horizontal member 17 which serves as a platform for powder supply system 12, with an upright member 18 for mounting to the press. Mounting bracket 23 has an upright gusset 19 which provides a surface for mounting components.

The powder supply system 12 is positioned upon mounting bracket 23 and consists generally of a external protective cover 20, externally mounted operating panel 30 (FIG. 1), control board 50 (FIG. 3 with electrical schematic at FIG. 15), hopper assembly 70, a powder transfer unit 90, a pneumatic supply system 125 (FIG. 13) and drive motors, 142 and 143.

External cover 20 encloses the powder supply system 12 to protect the system 12 from external contaminates, such as dust, ink, etc. A powder filling port 21 is provided on the upper surface of the external cover 20 which permits ease in refilling the supply of powder. A viewing window 22 permits a visual indication of the level of the remaining powder supply. External access to the power ON/OFF button 25 and for viewing air pressure gauge 26 are provided on the front of external cover 20. External cover 20 is removably attached to mounting bracket 23 by mounting screws 24.

Hopper assembly 70 serves as a storage and powder supply vessel for the powder sprayer 11. The hopper 71 consists of a tubular fill column 72, in this embodiment made of clear plastic, which has a clear plastic coverable, open top 73, hinged lid 74, having weight 75 and contains multiple light emitting diodes 76 (FIG. 8), connected electrically to control board 50, which illuminate when powder level detector 67 (FIG. 3) indicates a low powder level. Powder level detector 67 is a capacitive sensor of a known type, such as offered by Omron Corporation of Japan, which is mounted on and extends into the agitation chamber 77. Tubular fill column 72 descends into agitation chamber 77, having ledge 66, which is generally box-like in shape. The agitation chamber 77 has a partial semi-circular, curved bottom 79 with a radius generally corresponding to the length of agitator arm 80 of agitator assembly 81 (FIG. 5) which in operation minimizes excess powder build up in the agitation chamber 77. As further illustrated at FIG. 5*a*, agitation chamber 77 also includes ramp 69 which is a flattened portion of bottom 79. A brush port 82 is located in the lower portion of agitation chamber 77 adjacent ramp 69 which provides access for the transmission of powder from agitation chamber 77 into the adjacent powder chamber 91. Brush port 82 is a generally rectangular opening corresponding in height and width to the height and width of brush 83. Attached to the upper edge of brush port 82 is flicker bar 85. (FIG. 5)

Figure 3:
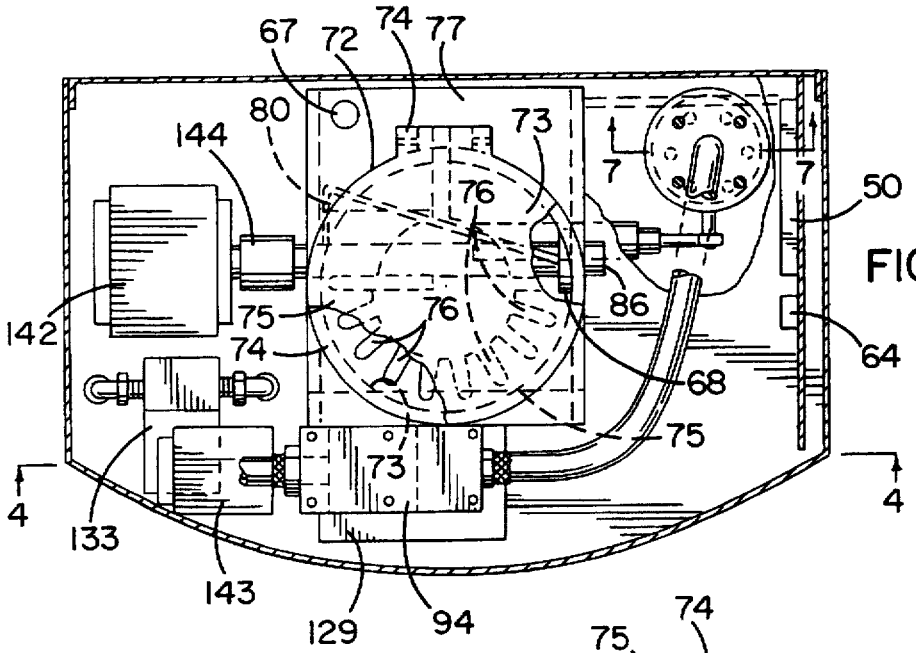
FIG. 3 is a top view of the powder supply system depicted in FIG. 1 with the top of the external cover removed.
Figure 4:
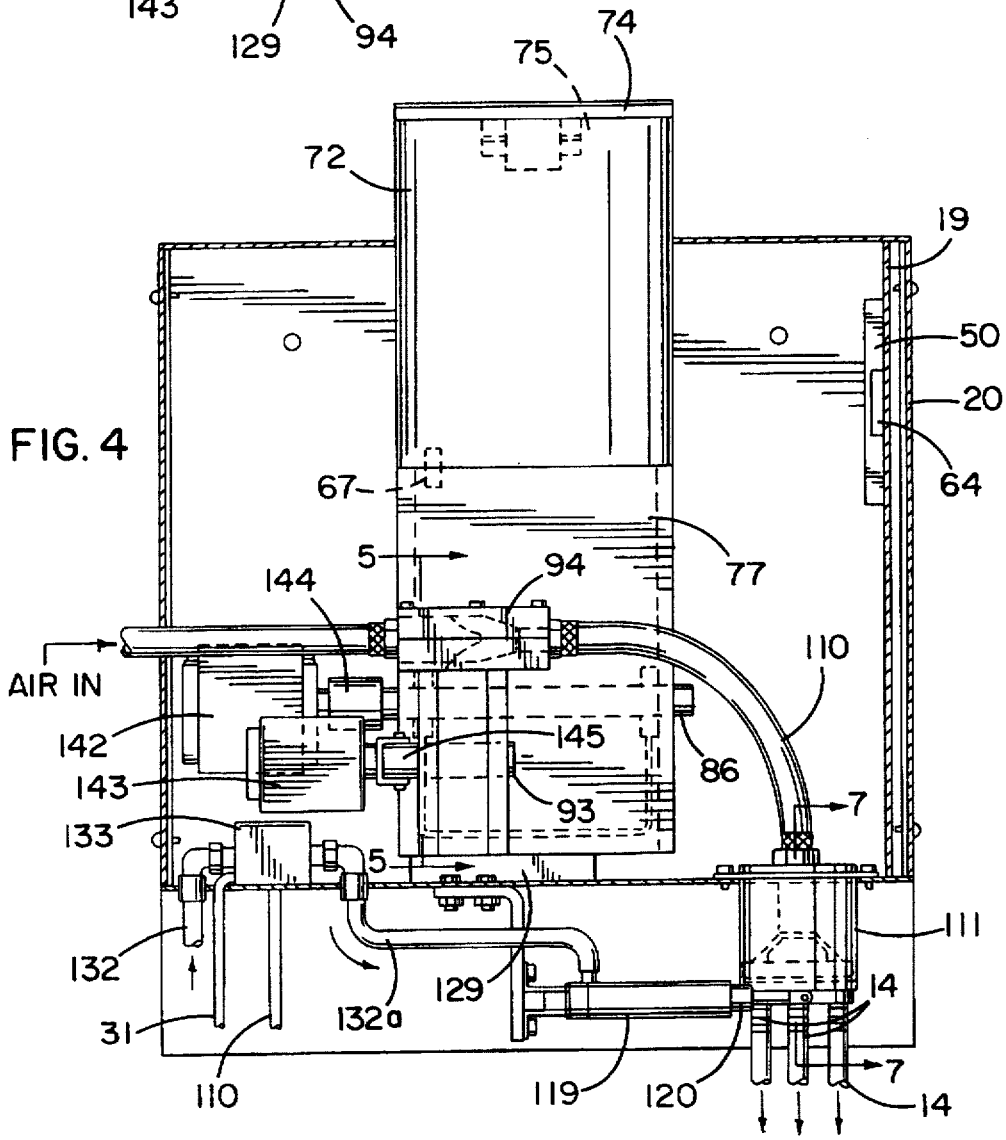
FIG. 4 is an enlarged vertical section of the powder supply system, taken in the plane of line 4—4 in FIG. 3.
Figure 8:
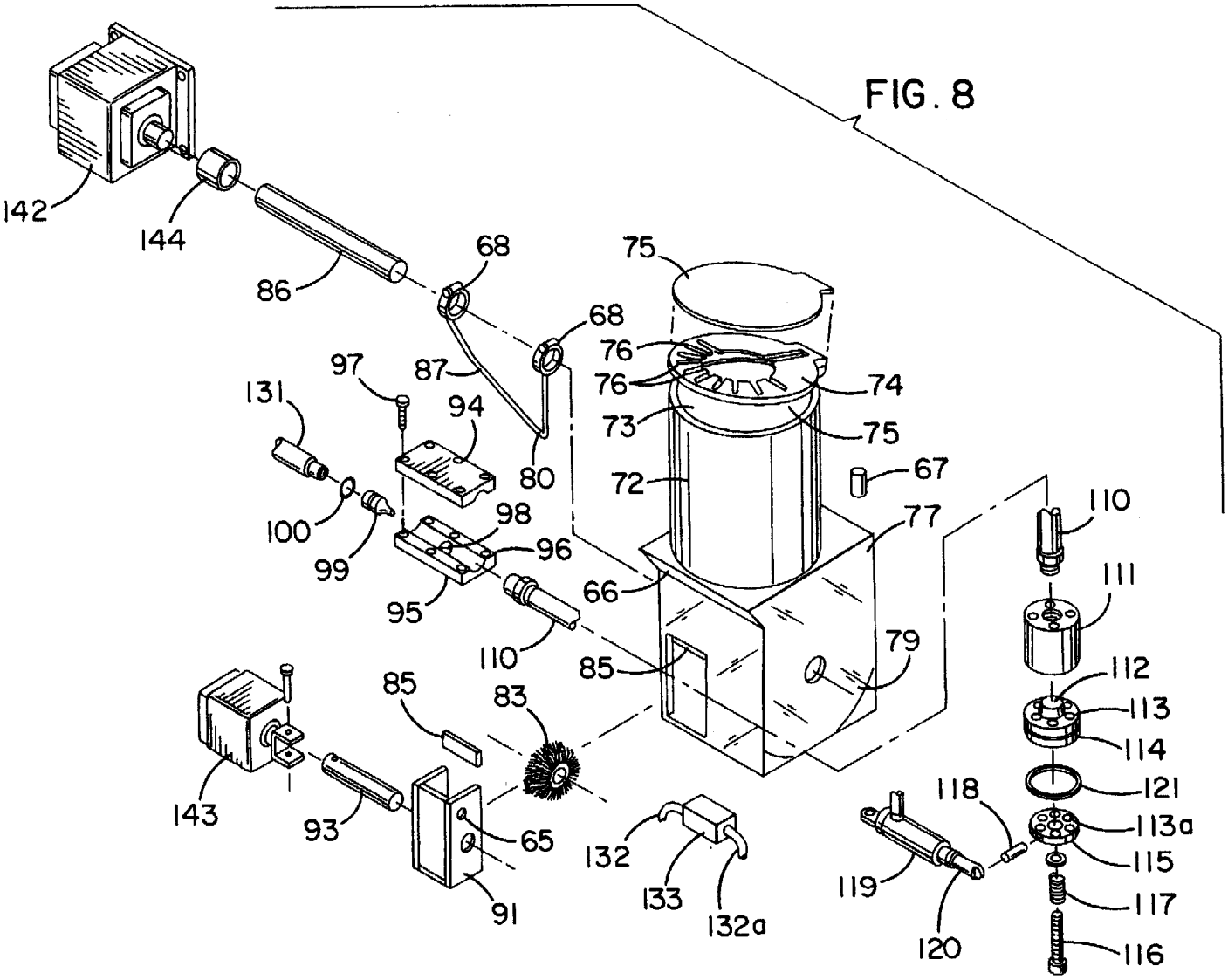
FIG. 8 is an exploded view of the powder supply system depicted in FIG. 4.

For agitating the powder supply, as shown in FIGS. 3, 4 and 8 in exploded view, rotatably mounted within the agitation chamber 77 on agitator axle 86 by locking collars 68 is a rotatable agitator arm 80. Blade portion 87 of agitator arm 80 is skewed as illustrated to provide for more thorough agitation of the powder. As shown in FIG. 5, the agitator arm 80 also acts as a sweep to agitate the powder and directs the powder onto ramp 69 for pick up by rotating brush 83.

For rotating agitator arm 80 within agitation chamber 77, as shown in FIG. 2, external of the hopper 70 is mounted an electric drive motor 142, which is a commercially manufactured motor having built in speed reduction gearing, such as offered by Dayton Electric Manufacturing Co. Model 2L004, and is connected by collar 144 (FIG. 3) to agitator axle 86 in order to provide rotation of agitator arm 80. Electric drive motor 142 is electronically controlled from operating panel 30.

Figure 5:
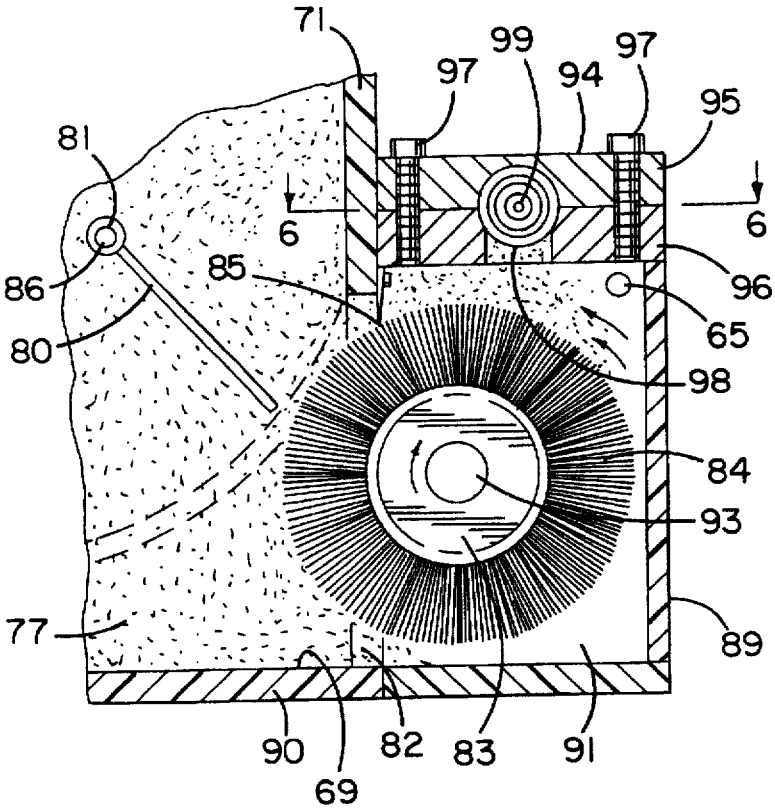
FIG. 5 is an enlarged vertical section of the powder chamber taken in the plane line of 5—5 in FIG. 4.
Figure 5A:
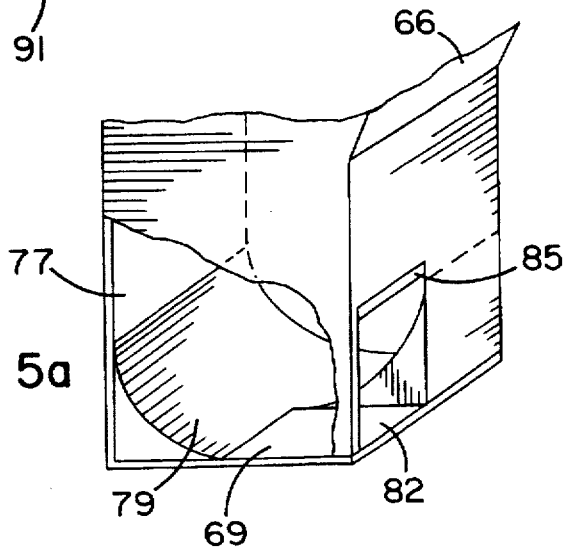
FIG. 5*a* *i*is a cut away perspective of the agitation chamber depicted in FIG. 5 showing the curved bottom with ramp.

The powder transfer unit 90, shown generally in FIG. 2 and more specifically in FIG. 5 and in the exploded view in FIG. 8, has a housing 89 adjacent the hopper 71 which defines a powder chamber 91, within which brush 83 is rotatably and axially mounted on the brush axle 93 (FIG.5). An air pressure equalization hole 65 is in each side of powder chamber 91. Holes 65 permit the influx of clean, dry air from within external cover 20 to equalize the air pressure within powder chamber 91. Brush 83 may be a portion of a commercially available type employed in the printing industry for use in cleaning blankets. Brush 83 has a cylindrical core with radially extending bristles 84. Bristles 84 must be sufficiently flexible to pick up powder from agitation chamber 77 so that, in passing flicker bar 85, the bristles 84 are slightly deflected by flicker bar 85 and, in springing back into their original configuration as brush 83 rotates, flick powder particles upwards into powder chamber 91. (FIG. 5) These airborne powder particles mix with the air inside powder chamber 91, with the powder particles suspended therein, creating an air and powder mixture.

The internal dimensions of powder chamber 91 are slightly larger than those of brush 83 in order to permit the rotation of brush 83 while restricting uncontrolled powder influx into the powder chamber 91 and powder build up within powder chamber 91. Any powder particles which are not vacuumed into the pneumatic hoses 14 by the process described herein, which then fall out of suspension, drop to the floor of powder chamber 91 and are swept back into agitation chamber 77 on ramp 69 through brush port 82 by the rotation of brush 83.

Figure 6:
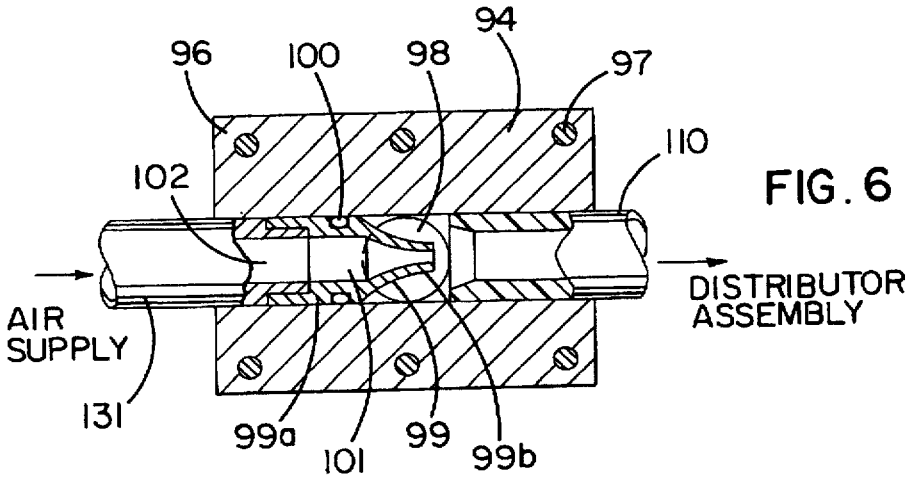
FIG. 6 is an enlarged horizontal section of the venturi manifold, taken in the plane of line 6—6 in FIG. 5.
Figure 7:
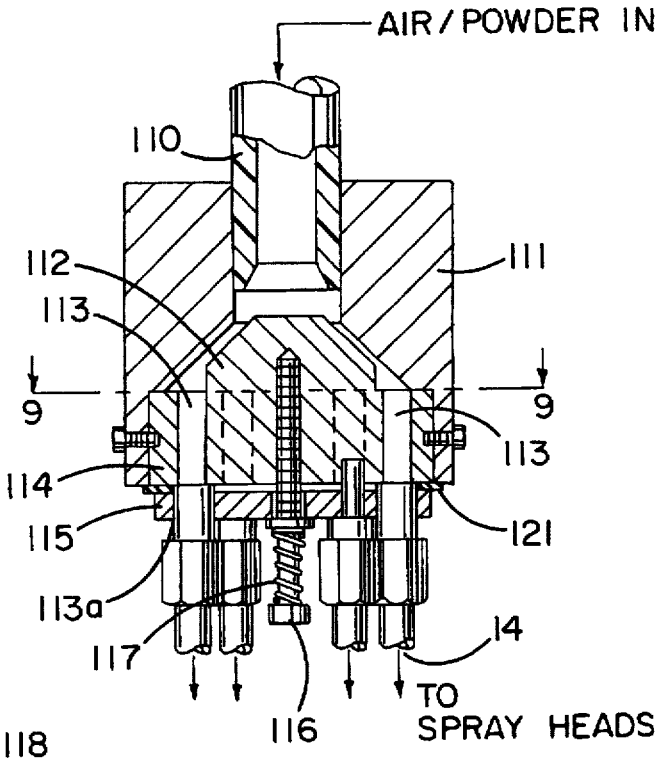
FIG. 7 is an enlarged vertical section of the powder distribution unit, taken in the plane of line 7—7 in FIG. 3.

As shown in FIG. 5 and FIG. 6 and in exploded view in FIG. 8, mounted on top of powder chamber 91 is venturi manifold 94, consisting of an upper venturi housing 95 and lower venturi housing 96 which have been channeled to receive the venturi nozzle 99. The venturi housings 95 and 96 are secured together by venturi housing bolts 97. Access to the powder chamber 91, through which the powder and air mixture in powder chamber 91 is vacuumed, is through venturi access port 98 in the lower venturi housing 96. Secured within the venturi manifold 94 is airflow amplifying venturi nozzle 99. As shown in FIG. 6, venturi nozzle 99 has a central passageway 101 communicating between upstream and downstream ends 99*a*, 99*b* thereof, respectively and a radially directed pressurized air inlet port 102 which is connected to venturi air conduit 131. Venturi nozzle 99 is provided with venturi sealing ring 100 in order to seal the fit of the venturi nozzle 99 within the venturi manifold 94. As shown in FIG. 6, the open end of the venturi nozzle 99 is positioned over venturi access port 98. Pressurized air is directed through venturi air conduit 131 in a downstream direction parallel to the axis of venturi nozzle 99 and perpendicularly passes over venturi access port 98 at an increased velocity. A low pressure area is thereby created over the venturi access port 98 which provides a vacuum effect, vacuuming the air and powder mixture from powder chamber 91 and propels that mixture through distributor tube 110 into the distributor assembly 111. Distributor assembly 111, as shown in FIG. 7 and in exploded view in FIG. 8, communicates with venturi nozzle 99 through distributor tube 110, made of commonly available polyvinylchloride tubing and is capable of providing the air and powder mixture to spray bar 13 through the selective positioning of distributor plates 114, 115 in order to utilize combinations of multiple pneumatic hoses 14 to accommodate various widths of printed sheets for an economic use of powder.

The air and powder mixture passing through distributor assembly 111 is deflected by the cone deflector 112, which occupies space, and which channels the air and powder mixture into multiple hose ports 113 on the fixed distributor plate 114. Rotatably connected to the fixed distributor plate 114 is the rotatable distributor plate 115, having multiple hose ports 113*a*, which is axially mounted on distributor axle 116 and compressed against the fixed distributor plate 114 by spring 117 in order to minimize powder from escaping between plates 114 and 115. A gasket 121 is positioned between fixed distributor plate 114 and rotatable distributor plate 115 to provide for smooth rotation at the interface and to act as a seal.

Figure 9:
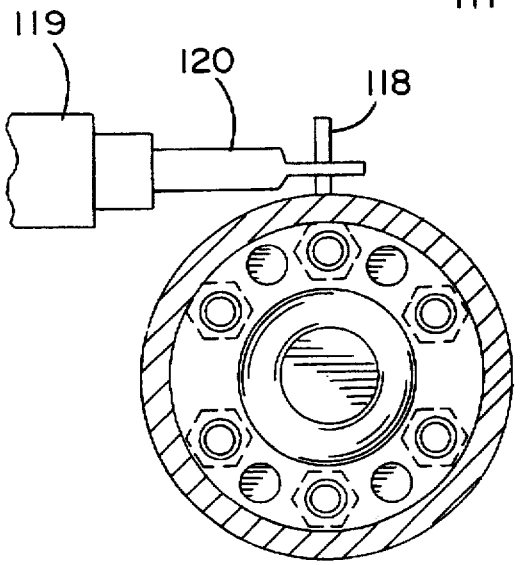
FIG. 9 is an enlarged horizontal section of the distributor in the full open position, taken in the plane of line 9—9 in FIG. 7.
Figure 10:
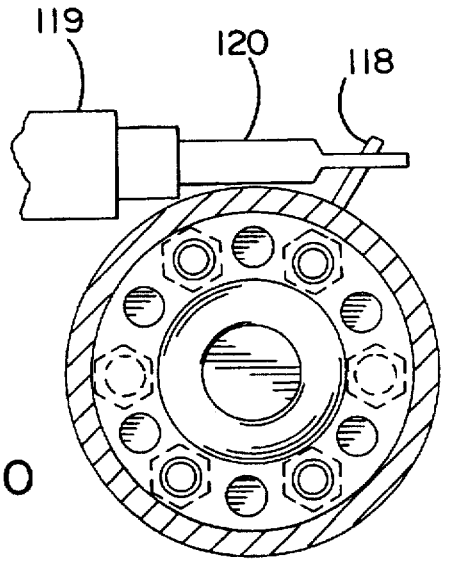
FIG. 10 is an enlarged horizontal section, similar to FIG. 9, but showing the distributor in the partially open position.

For distributing powder, as shown in FIG. 9, rotation arm 118 on the rotatable distributor plate 115 is connected to an air actuated cylinder 119 by piston 120, which communicates with cylinder air conduit 132*a*. Pressurized air (FIG. 13) is provided to solenoid 133 from air manifold 129, as described below, through solenoid air conduit 132. Upon activation of solenoid 133 through electronic communication with control board 50, pressurized air flows to air actuated cylinder 119 which extends piston 120, thereby moving rotation arm 118 about axle 116, thus rotating distributor plate 115 between a full open position and a partially open position, wherein six pneumatic hoses 14 can be supplied with the air and powder mixture as seen in FIG. 9 or alternatively four pneumatic hoses as seen in FIG. 10. In such a way, rotating the rotatable distributor plate 115 permits selective spraying of either the entire width of the press or a narrower width for the narrower width printed sheets.

For supplying pressurized air to the powder spray system 11, a pneumatic supply system 125 is provided. To simplify the mechanical figures, pneumatic hoses and conduits are shown diagrammatically in FIG. 13. Pneumatic supply system 125 consists of a pressure switch activated external air compressor 126, which may be of a known type, such as offered by Thomas Industries, Inc. of Sheboygan, Wis. Compressor 126 is equipped with solid particulate filter 127 which filters any existing solid particulate matter from the pressurized air. A refrigerated air dryer 128, which may be of a known type, such as offered by Wilkerson Corporation of Englewood, Colo., is provided which minimizes any moisture which may be in the pressurized air, thus providing clean, dry pressurized air to the powder spray system.

Figure 13:
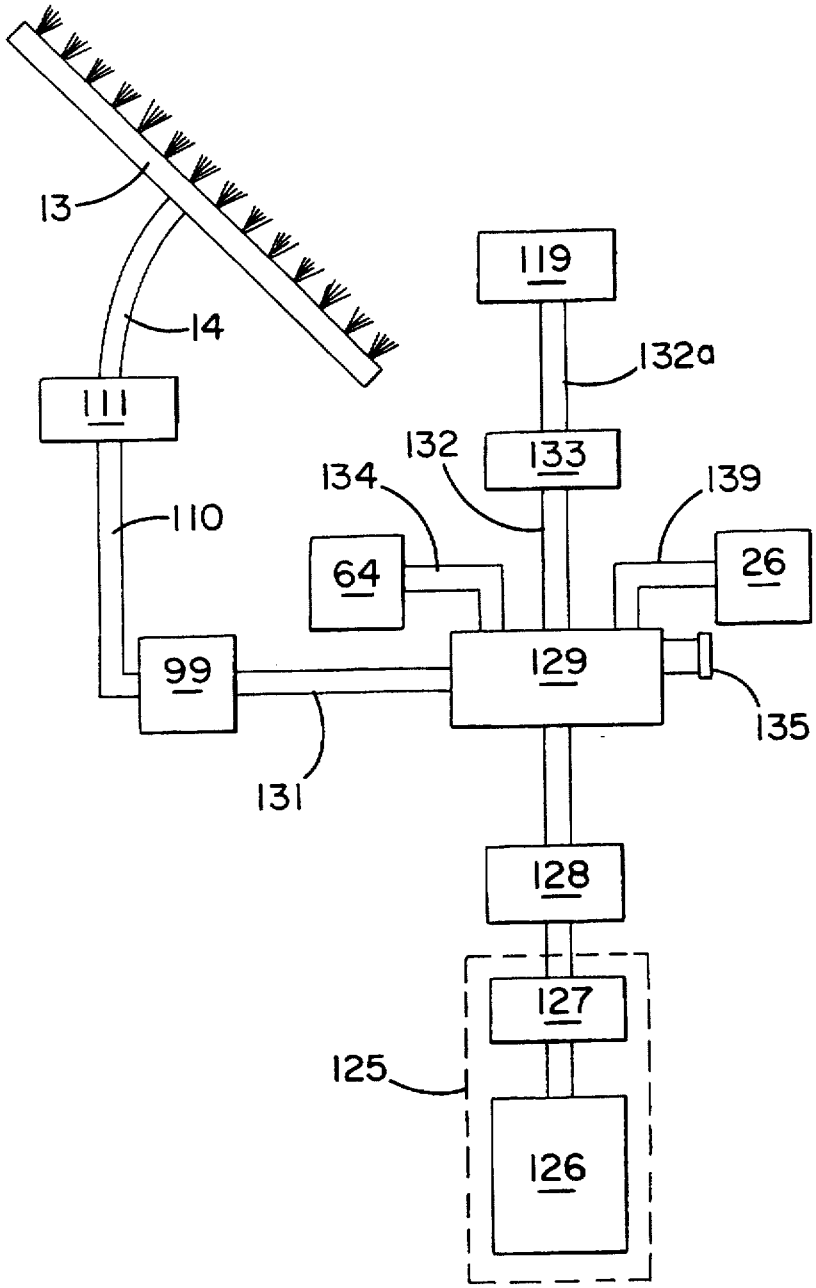
FIG. 13 is a diagrammatic illustration of an embodiment of the pneumatic propulsion system of the present invention.

As shown in FIG. 13, this pressurized air enters the pneumatic propulsion system 125, in the preferred embodiment at between 20–30 psi, and passes downstream into air manifold 129 through in-coming air supply conduit 130. Air manifold 129 is a box-like chamber with five air output conduits. Venturi air conduit 131 provides pressurized air and powder mixture to venturi 5 nozzles 99 (FIG. 6) which, in turn, flows through distributor tube 110 to distributor assembly 111, through pneumatic hoses 14 to sprayer bar 13. Solenoid air conduit 132 provides pressurized air to solenoid 133 then, upon activation, through air cylinder conduit 132*a* for operating air cylinder 119 as addressed above. Transducer air conduit 134 provides pressurized air to transducer 64, mounted on gusset 19 which activates an electronic alarm on control board 50 when the air pressure drops below a certain present level, in the preferred embodiment, 18 psi. Air pressure gauge conduit 139 provides pressurized air to air pressure gauge 26 mounted on external cover 20. (FIG. 2) Chamber air valve 135 vents pressurized air into the interior of the powder supply system 11 when external cover 20 is in place (FIG. 1), thereby filling the interior with clean, dry air.

Figure 11:
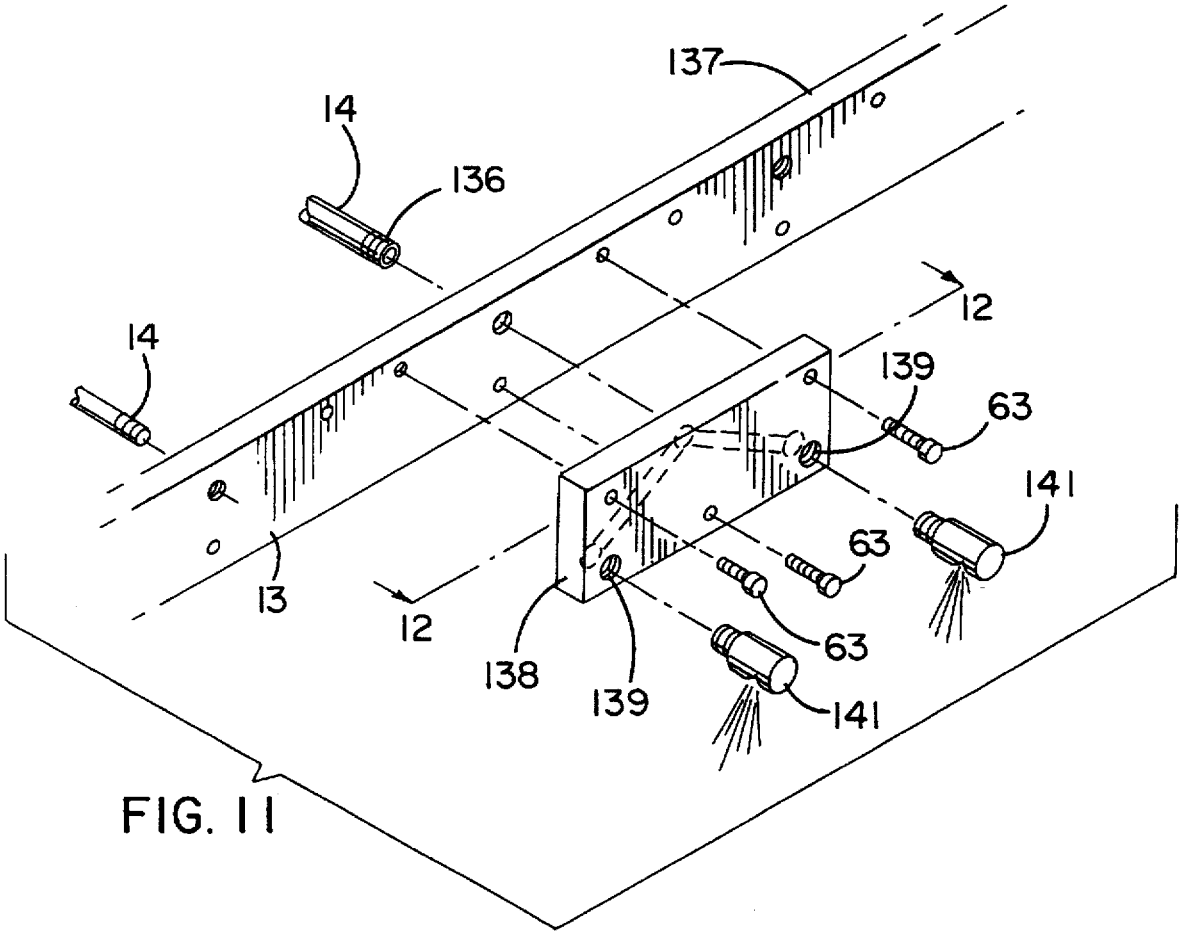
FIG. 11 is an exploded perspective view of the sprayer bar depicted in FIG. 1.
Figure 12:
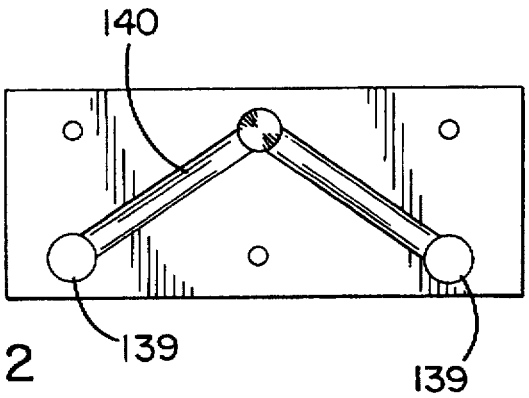
FIG. 12 is an enlarged vertical section of a nozzle plate, taken in the plane of line 12—12 in FIG. 11.

The pneumatic hoses 14, as shown in FIG. 11, may be of a known type commonly available are connected through nozzle connections 136 may be of a known type, such as offered by Parker of Ravenna, Ohio under the trademark Compress-a-line, to the sprayer bar 13. The sprayer bar 13 is comprised of a back plate 137 which runs the width of the press. (FIG. 1) Attached to the back plate 137 by securing screws 63 are multiple nozzle plates 136 (FIG. 1), each having two nozzle ports 139 and interconnecting channels 140, for channelling powder from a single pneumatic hose 14 to a pair of nozzle ports 139. Attached to each nozzle port 139 is a nozzle 141 which may be of a known type, such as offered by Spraying Systems Company of Carol Steam, Ill., which directs the air and powder mixture downward onto the printed sheets 15 as they pass beneath the powder sprayer 11.

For providing rotational motion to agitator arm 80, as shown in FIG. 4, an electric motor 142 is provided. The speed of motor 142 is controllable from operation panel 30. Motor 142 connects with agitator axle 86 through collar 144. For providing rotational motion to brush 83 an electric motor 143, which may be of a known type, such as offered by Dayton Electric Manufacturing Co. Model 2L004, is provided, the speed of which is similarly controlled from operation panel 30. Motor 143 connects with brush axle 93 through collar 145.

Operation panel 30 which serves as the operator interface with the various electrical and pneumatic devices of the powder spray system 11 is externally mounted on the press 10 and is connected to the control board 50 mounted on gusset 19 by operating cable 31. Depressing ON/OFF button 25 on external cover 20 powers up operation panel 30. Operation panel 30 presents a touch-activated liquid crystal display panel which prompts the operator with a series of display screens 31. (FIGS. 14*a*–14*c*) Prompt screens inquire about certain information from the operator relating to powder spray system parameters.

Figure 14A:
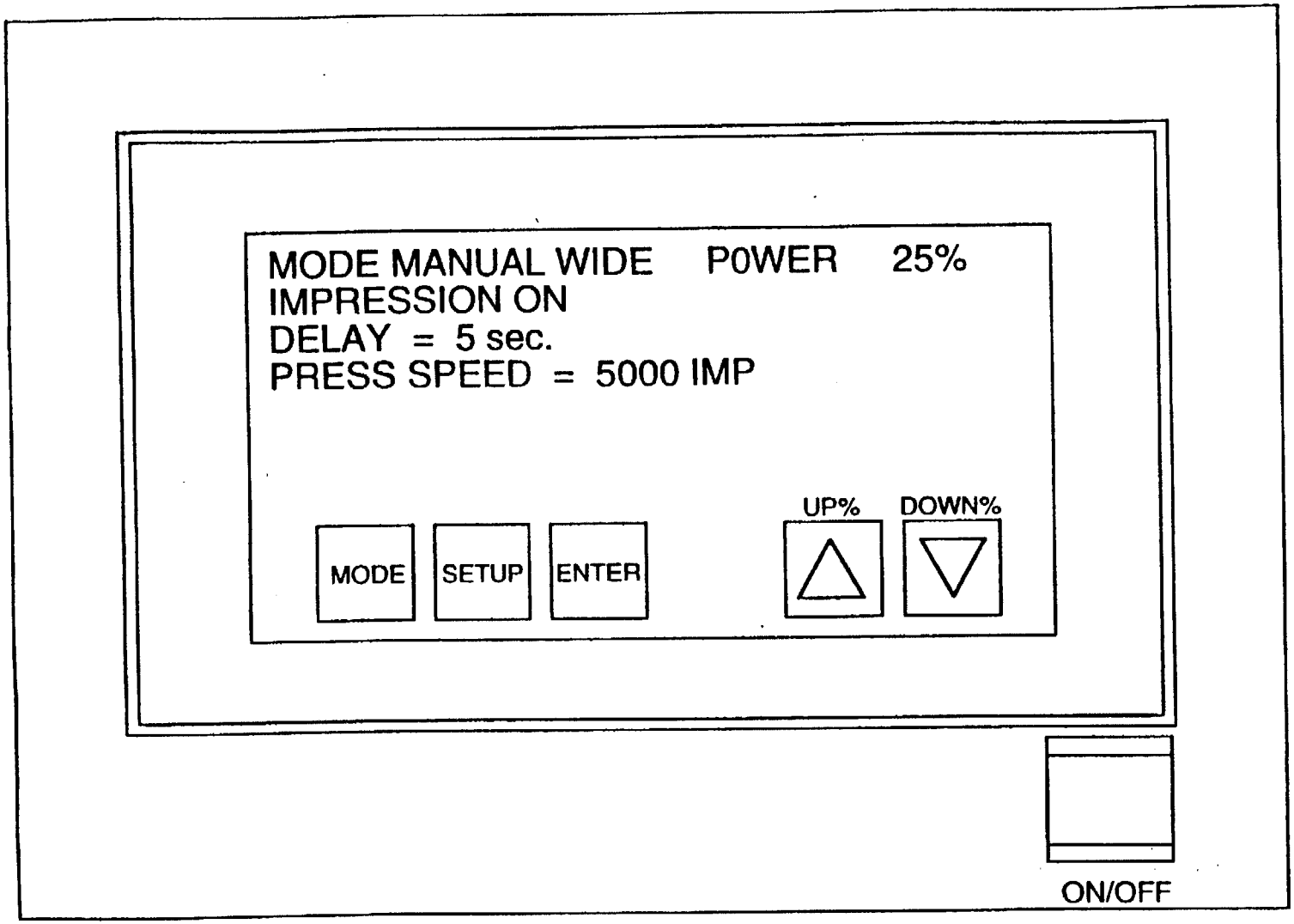
FIGS. 14*a*, 14*b*, and 14*c* are diagrammatic illustrations of touch screens displayable on the operation panel of an embodiment of the present invention as shown in FIG. 1.
Figure 14B:
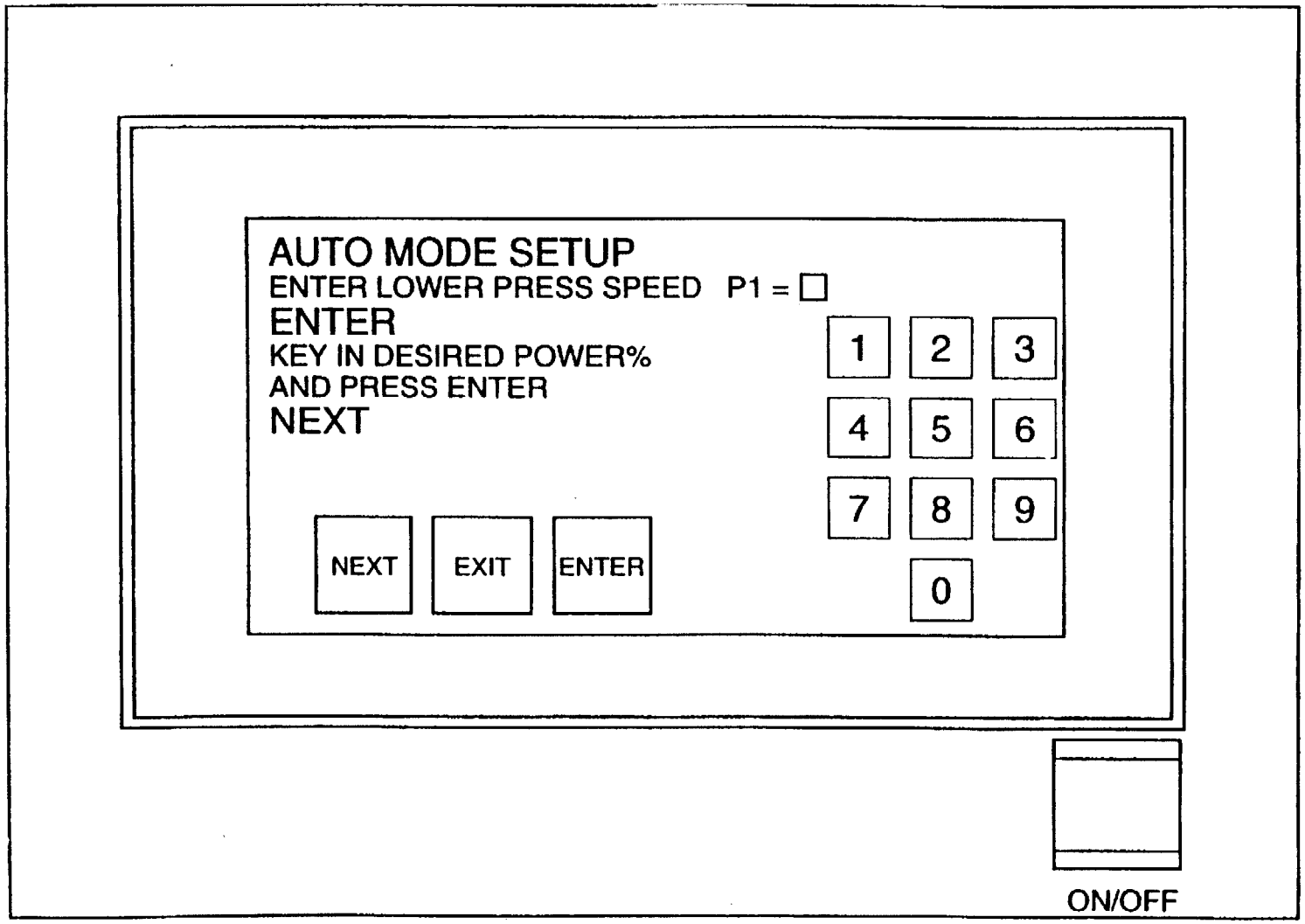
Figure 14C:
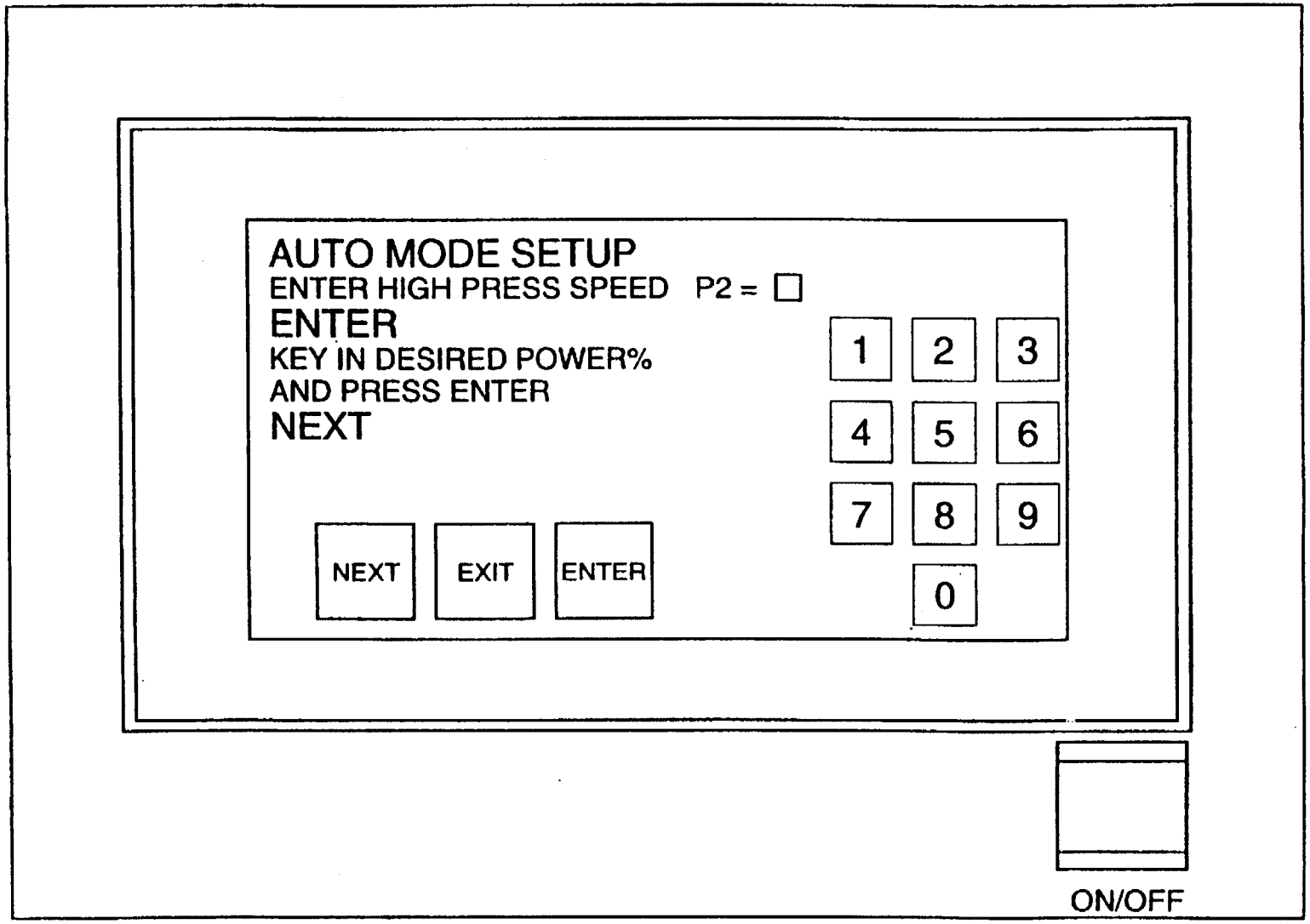

Prompt screen shown at FIG. 14*a*, for example, presents a powder spray system 11 in the MODE MANUAL which permits the manual adjustment of spray system parameters by the operator. Selection of the SETUP position in this particular screen presents a series of subsequent prompt screens which provide for selective settings for the control of the speed of brush motor 143; for the activation of the distributor assembly 111, as described above, to select a width of the spray; for a pre-set delay in stopping period so that, when the press goes off impression, remaining printed sheets which will continue for a short period of time to pass through the press will be properly sprayed; for the independent operation of the powder spray system 11 without the press running in order to test the powder spray system 11; and to turn off brush motor 143, while leaving the pneumatic supply system 125 in operation in order to purge the spray system without a continuing powder flow. Subsequent screens permit the resetting of the powder level detector 67 and/or the air pressure alarm from control board 50 if activated; and for the automatic purging of the powder system when the press goes off impression in the manner addressed above.

Additional screens are presented in the event the AUTO mode is selected which permit the entry of press speed lower (FIG. 14*b*) and upper (FIG. 14*c*) parameters and powder percentages. As with the manual mode screens, subsequent screens control spray system functions.

Operation panel 30 communicates electronically with control board 50 through operating cable 31, which enters the powder spray system 11 through access 32 in horizontal member 17 of mounting bracket 23. It will be understood by one skilled in the art that the control board 50 may be coupled to appropriate electrical circuitry for controlling all functions of the powder spray system.

The electronic design to implement the operation panel 30 with electronic prompt screens, data entry, memory recordation, and interface with control board 50 is conventional and within the skill of one of ordinary skill in the art of digital electronics and, therefore, is not described in detail herein.

In operation, parameters for the powder spray system 11 are established through operator selection at the operation panel 30 as addressed above. The electric drive motor 142 is activated, and rotates the agitator arm 80 within agitation chamber 77 so that powder is agitated and swept onto ramp 69. Electric drive motor 143 rotates brush 83 in a direction such that brush 83 picks up powder and carries it upwardly and past flicker bar 85 causing deflection of the brush bristles 84 and upon passage of the flicker bar 85 causes the bristles to flick powder into the ambient air inside the powder chamber 91 thereby creating an air and powder mixture with the powder suspended therein.

Pressurized air passing through the venturi manifold 94, passes through the venturi nozzle 99 at high velocity serves to vacuum the air and powder mixture from the powder chamber 91 up through the venturi access port 98 and carries that powder through the distributor assembly 111, through the pneumatic hoses 14, and out the nozzles 138 on the spray bar onto the printed sheets 15.

One preferred use of the foregoing device is in conjunction with a printing press. The methods by which the inventive device can be mounted on and used in conjunction with such printed presses, to the extent not described herein, will be appreciated by those skilled in the art.

While this invention has been described with an emphasis upon one or more preferred embodiments, it will be obvious to those of ordinary skill in the art that variations of the preferred devices and methods may be used and that it is intended that the invention may be practiced otherwise than as specifically described herein. Accordingly, this invention includes all modifications encompassed within the spirit and scope of the invention as defined by the following claims.

We claim as our invention:

1. A powder spray system for directing powder onto a substrate comprising a hopper for containing a supply of powder, a housing which defines a chamber, a rotatable brush having flexible bristles for receiving powder from said hopper and for propelling the received powder airborne into said chamber, and a pneumatic powder transport system for transporting airborne powder from said chamber to said substrate.

2. The powder spray system of claim 1 wherein said hopper includes an external cover.

3. The powder spray system of claim 2 wherein said external cover includes a viewing window for ascertaining remaining powder supply in said powder supply hopper.

4. The powder spray system of claim 1 wherein said source of pressurized air is an air compressor.

5. The powder spray system of claim 4 wherein said air compressor further comprises a solid particulate filter and a refrigerated air dryer.

6. The powder spray system of claim 1 in which said hopper is formed with an opening communicating with said chamber, said brush being disposed within said opening, and a flicker bar being disposed at an upper end of said opening for contact by said brush.

7. The powder spray system of claim 1 in which said brush is at least partially disposed in said hopper.

8. The powder spray system of claim 7 in which said hopper is formed with an opening communicating with said chamber, and said brush is disposed within said opening.

9. The powder spray system of claim 8 in which said opening is in the side of said hopper, and said brush is rotated in a direction such that a lower side thereof moves in a direction into said hopper and an underside thereof moves in a direction out of said hopper.

10. The powder spray system of claim 9 in which said brush is disposed in closely spaced adjacent relation to a bottom of the chamber for directing powder that falls to the bottom of the chamber back into said hopper.

11. The powder spray system of claim 8 in which said opening and brush are disposed in one side of said hopper, and said hopper has a semicircular curved bottom wall on a side opposite said brush and opening for directing powder in said hopper towards said brush and opening.

12. The powder spray system of claim 8 in which said brush has radial bristles, and including a flicker bar disposed adjacent an upper end of said brush, said flicker bar being engageable by the bristles of said brush as said brush is rotated for flexing the bristles such that upon passage beyond the flicker bar the bristles are released and propel the powder carried by the brush airborne into said chamber.

13. The powder spray system of claim 1 including a pressurized air source, a pressurized air supply line communicating with said pressurized air source and through which a pressurized air flow is directed, a venturi nozzle connected to said pressurized air supply line for creating a high velocity discharging air flow and for creating a low pressure zone communicating with said chamber for drawing airborne powder in said chamber into said high velocity air flow, and a powder supply line connected to said venturi through which airborne powder drawn from said chamber is directed by said high velocity air flow to said substrate.

14. The powder spray system of claim 13 in which said low pressure zone is connected to said chamber by an access port in said housing.

15. The powder spray system of claim 14 in which said access port extends through a top side of said housing.

16. The powder spray system of claim 13 including a spray bar having a plurality of laterally spaced spray nozzles for receiving airborne powder from said supply line and for directing the airborne powder across a width of said substrate.

17. The powder spray system of claim 1 in which said pneumatic powder transfer system includes a selectively adjustable distributor for channeling airborne powder into a plurality of air flow conduits, said distributor including a pair of relatively rotatable distributor plates each formed with a plurality of air flow apertures, at least one of said plates being selectively rotatable between one position in which one set of apertures in said plates are aligned for permitting airborne powder to flow through one set of said conduits and a second rotated position in which a second set of said apertures in said plates are aligned different from said first set of aligned apertures for permitting air and powder flow to a second set of said conduits different from said first set of conduits.

18. The powder spray system of claim 17 including a spray bar having a plurality of discharge nozzles along the length thereof, and said plurality of conduits being connected to said spray bar.

19. The powder spray system of claim 1 including a power operated agitator within said hopper for agitating powder adjacent said brush.

20. The powder spray system of claim 19 in which said agitator includes a rotatable agitator arm moveable in a circle adjacent said brush.

21. A powder spray system for directing powder onto a substrate comprising a hopper for containing a supply of powder, a housing which defines a chamber, a dispensing element for receiving powder from said hopper and for directing predetermined quantities thereof into said chamber such that at least a portion of the directed powder is airborne in said chamber, a pneumatic powder transport system for transporting airborne powder from said chamber to said substrate, said pneumatic powder transfer system including a selectively adjustable distributor for channeling airborne powder into a plurality of air flow conduits, said distributor having a pair of relatively rotatable distributor plates each formed with a plurality of air flow apertures, at least one of said plates being selectively rotatable between one position in which one set of apertures in said plates are aligned for permitting airborne powder to flow through one set of said conduits and a second rotated position in which a second set of said apertures in said plates are aligned different from said first set of aligned apertures for permitting air and powder flow to a second set of said conduits different from said first set of conduits.

22. The powder spray system of claim 21 including a spray bar having a plurality of discharge nozzles along the length thereof, and said plurality of conduits being connected to said spray bar.

23. The powder spray system of claim 21 including a pressurized air source, a pressurized air supply line communicating with said pressurized air source and through which a pressurized air flow is directed, a venturi nozzle connected to said pressurized air supply line for creating a high velocity discharging air flow and for creating a low pressure zone communicating with said chamber for drawing powder in said chamber into said high velocity air flow, and a powder supply line connected to said venturi through which powder drawn from said chamber is directed by said high velocity air flow to said substrate.

24. A printing press comprising a delivery end for receiving printed pages, a powder supply system including a powder sprayer for directing powder onto printed sheets as they are directed to the delivery end, said powder sprayer including a spray bar with a plurality of spray nozzles, a hopper for containing a supply of powder, a housing which defines a chamber, a rotatable brush having flexible bristles for receiving powder from said hopper and for propelling the received powder airborne into said chamber, and a pneumatic powder transport system for transporting airborne powder from said chamber to said spray bar.

25. The powder spray system of claim 24 in which said hopper is formed with an opening communicating with said chamber, said brush is disposed within said opening and being rotated in a direction such that a lower side thereof moves in a direction into said hopper and an underside thereof moves in a direction out of said hopper.

26. The powder spray system of claim 25 in which said brush has radial bristles, and including a flicker bar disposed adjacent an upper end of said brush, said flicker bar being engageable by the bristles of said brush is rotated for flexing the bristles such that upon passage beyond the flicker bar the bristles are released and propel the powder carried by the brush airborne into said chamber.

27. A printing press comprising a delivery end for receiving printed pages, a powder supply system for directing powder onto printed sheets as they are directed to the delivery end, said powder sprayer including a spray bar with a plurality of spray nozzles, said spray bar having a plurality of air flow conduits, a hopper for containing a supply of powder, a housing which defines a chamber, a dispensing element for receiving powder from said hopper and for directing predetermined quantities thereof into said chamber such that at least a portion of the directed powder is airborne in said chamber, a pneumatic powder transport system including an adjustable distributor for selectively directing and channeling airborne powder from said chamber into a plurality of said air flow conduits, said distributor having a pair of relatively rotatable distributor plates each formed with a plurality of air flow apertures, at least one of said plates being selectively rotatable between one position in which one set of apertures in said plates are aligned for permitting airborne powder to flow through one set of said conduits and a second rotated position in which a second set of said apertures in said plates are aligned different from said first set of aligned apertures for permitting air and powder flow to a second set of said conduits different from said first set of conduits.

* * * * *